US006300712B1

(12) United States Patent
Gorog et al.

(10) Patent No.: US 6,300,712 B1
(45) Date of Patent: Oct. 9, 2001

(54) COLOR PICTURE TUBE HAVING IMPROVED SHADOW MASK-FRAME ASSEMBLY SUPPORT

(75) Inventors: Istvan Gorog, Lancaster; Anthony Socrates Poulos, Leola; Kelly Eugene Hamm, Holtwood, all of PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/253,825

(22) Filed: Feb. 19, 1999

(51) Int. Cl.[7] ..... H01J 29/80
(52) U.S. Cl. ..... 313/406; 313/404; 313/407
(58) Field of Search ..... 313/404, 406, 313/407

(56) References Cited

U.S. PATENT DOCUMENTS 3,997,811 12/1976 Tom et al. ..... 313/404
4,318,025 * 3/1982 Penird et al. ..... 313/404
5,576,595 * 11/1996 Inoue ..... 313/406
5,606,377 * 2/1997 Swank ..... 313/404

FOREIGN PATENT DOCUMENTS

0325207 A2 7/1989 (EP) ..... H01J/29/07

* cited by examiner

*Primary Examiner*—Frank G. Font
*Assistant Examiner*—Roy M. Punnoose
(74) *Attorney, Agent, or Firm*—Joseph S. Tripoli; Dennis H. Irlbeck

(57) ABSTRACT

A color picture tube includes an evacuated envelope having a rectangular faceplate panel with two approximately parallel long sides, two approximately parallel short sides and four corners. The panel comprises a faceplate and a peripheral sidewall, and includes a shadow mask-frame assembly mounted therein by springs located at the four corners of the panel. The springs have apertures engaging studs that are located on the peripheral sidewall at the four corners. The panel includes additional studs on the peripheral sidewall located near the centers of at least one pair of approximately parallel sides of the panel. Brackets are located on opposite sides of the shadow mask-frame assembly at the locations of the additional studs. The brackets include slots therein. The slots are open on sides thereof facing the faceplate. The additional studs are positioned within the slots.

6 Claims, 3 Drawing Sheets

COLOR PICTURE TUBE HAVING IMPROVED SHADOW MASK-FRAME ASSEMBLY SUPPORT

This invention relates to a color picture tube having a shadow mask attached to a peripheral frame which is suspended in relation to a cathodoluminescent screen and, particularly, to a support system for a mask-frame assembly in such a tube, which provides an improved shock handling capability.

BACKGROUND OF THE INVENTION

In most color picture tubes, a peripheral frame, supporting a shadow mask, is suspended in a faceplate panel by means of springs that are welded either directly to the frame or to plates which in turn are welded to the frame. In large size tubes, it is common to use four springs to support a mask-frame assembly within a rectangular faceplate panel of a tube. In many recent tubes, the springs are located at the four corners of the frame to minimize twisting and shifting of the assembly within the panel. An aperture in each spring engages a metal stud that is embedded in an interior corner of a glass panel. An embodiment for achieving such corner support is disclosed in U.S. Pat. No. 4,723,088, issued to Sone et al. on Feb. 2, 1988. That patent shows a mask frame having truncated corners with supports at each corner. In the examples designated "prior art", the mask-frame assembly supports are bent metal plates that are welded to the frame at one end and include an aperture at the other end. The aperture engages a metal stud that is embedded in the panel sidewall. The Sone et al. patent teaches forming each support from two members that are welded together. A first member, having a flat plate shape, is welded at several separated points to a mask frame. The second member is welded to the first member at one end and includes an aperture at the other end that engages a support stud in the panel sidewall.

The use of a corner support system for the support of a color picture tube shadow mask offers many advantages over an on-axis support system. However, the corner support system has the undesirable characteristic of asymmetric resistance to shock loads. Tubes employing corner support systems typically are less capable of sustaining shock loads in the horizontal (X) direction and returning the shadow mask to within a tolerable distance of its original position, than it is for vertical (Y) direction shock loads.

The measure of shock handling capability is a permanent deformation of the mask support system caused by subjecting tube assemblies to X-direction acceleration. Such deformation commonly lead to misalignment of the mask apertures with respect to their nominal positions, which, in turn, causes positional errors in the landings of the electron beams. Such mislandings are commonly referred to as misregistration, and, in operating tubes, the consequences of misregistration are white field nonuniformities and color purity errors. As is well known in the art, the continuous line screen tubes, by their basic operational principal, are very tolerant to Y-direction registration errors, but very intolerant to X-direction registration errors.

As usually mounted on a shadow mask frame, the corner support system springs are typically flexible in the radial direction and very stiff in the tangential direction. These springs are typically mounted at the mask diagonal corners. Because the mask diagonal does not lie at 45 degrees to the X and Y axes, e.g., in a tube having a 4×3 or 16×9 (X to Y) aspect ratio, the resulting system stiffnesses in the X and Y directions are not equal.

In 4×3 aspect ratio tubes, a line connecting the springs on opposite corners makes an angle of 36.87 degrees with respect to the horizontal (X) axis. One skilled in the art would anticipate that the horizontal (X) direction shock handling capability would be about 75% (tan 36.87 degrees) of that in the vertical (Y) direction. For 16×9 aspect ratio tubes, the difference between the shock load handling capabilities in the X and Y directions is anticipated to be even greater. The spring diagonal angle for a 16×9 aspect ratio tube is usually 29.00 degrees. This indicates that one should expect that the X direction shock handling capability would be about 55% (tan 29.00 degrees) of that in the Y direction. It has been found that the shock handling capability of such a 16×9 aspect ratio tube can be unacceptable in many applications. The present invention addresses the problem of inadequate shock load capability in a 16×9 aspect ratio tube.

SUMMARY OF THE INVENTION

In accordance with the present invention, a color picture tube includes an evacuated envelope having a rectangular faceplate panel with two approximately parallel long sides, two approximately parallel short sides and four corners. The panel comprises a faceplate and a peripheral sidewall. The panel includes a shadow mask-frame assembly mounted therein by springs located at the four corners of the panel. The springs have apertures engaging studs that are located on the peripheral sidewall at the four corners. The panel includes additional studs on the peripheral sidewall located near the centers of at least one pair of approximately parallel sides of the panel. Brackets are located on opposite sides of the shadow mask-frame assembly at the locations of the additional studs. The brackets include slots therein. The slots are open on sides thereof facing the faceplate. The additional studs are positioned within the slots.

DETAILED DESCRIPTION OF THE PREFERRED EMBODIMENTS

Figure 1:
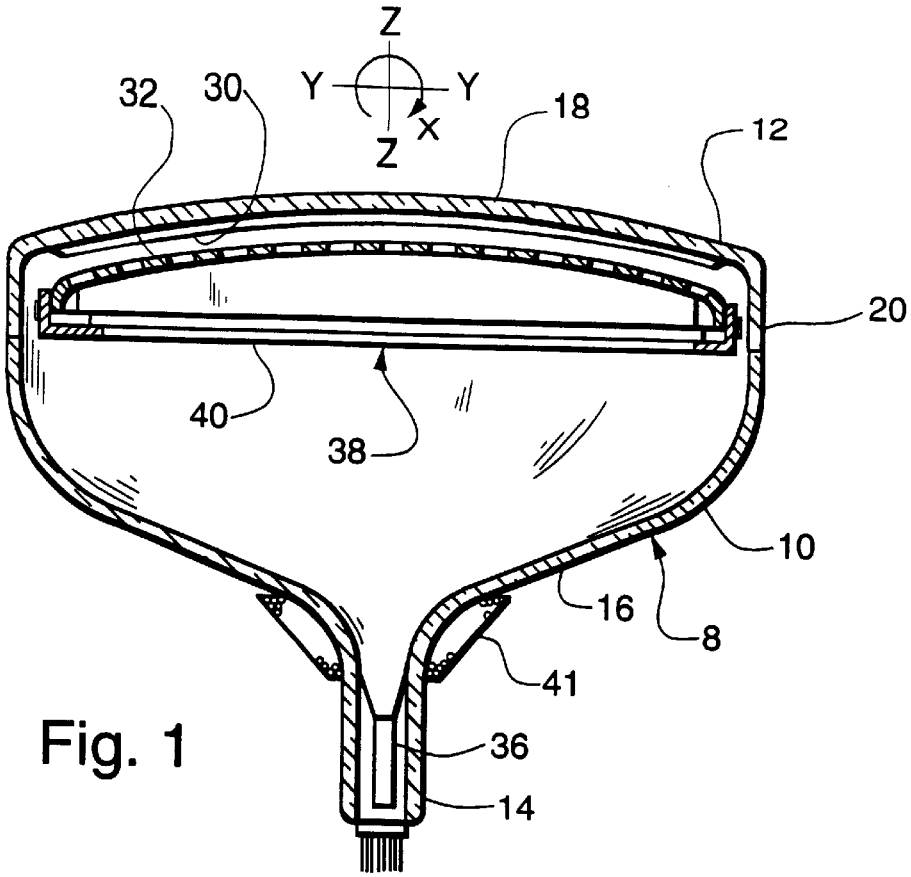
FIG. 1 is an axially sectioned side view of a color picture tube embodying the present invention.
Figure 2:
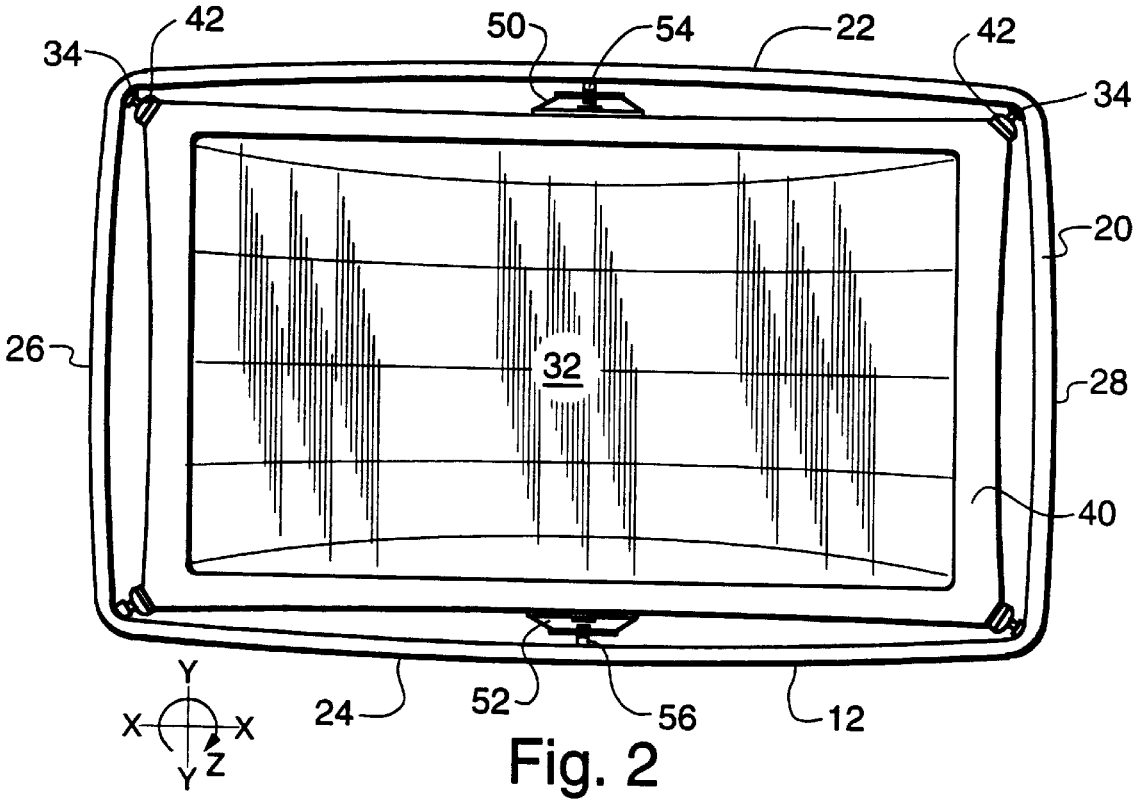
FIG. 2 a plan view of a shadow mask-frame assembly mounted within the faceplate panel of the tube of FIG. 1.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12, also shown in FIG. 2, includes two orthogonal axes: a major axis X, paralleling two approximately parallel long sides 22 and 24 (usually horizontal) of the panel 12, and a minor axis Y, paralleling two approximately parallel short sides 26 and 28 (usually vertical) of the panel 12. The major and minor axes are perpendicular to a central longitudinal axis Z of the tube which passes through the center of the neck 14 and the center of the panel 12. A mosaic three-color phosphor screen 30 is carried by the inner surface of the faceplate 18. The screen 30 preferably is a line screen with the phosphor lines extending substantially parallel to the minor axis Y. Alternatively, the screen may be a dot screen. A multiapertured color selection electrode or shadow mask 32 is removably mounted within the panel 12. The shadow mask 32 is part of a mask-frame assembly 38 that also includes a peripheral frame 40. The mask-frame assembly 38 also includes four springs 42 that engage four support studs 34, which are embedded in the four corners of the panel 12, in predetermined spaced relation to the screen 30. An electron gun 36 is centrally mounted within the neck 14, to generate and direct three electron beams along convergent paths through the mask 32 to the screen 30. A magnetic deflection yoke 41 is attached to the tube at the neck-to-funnel junction.

Figure 3:
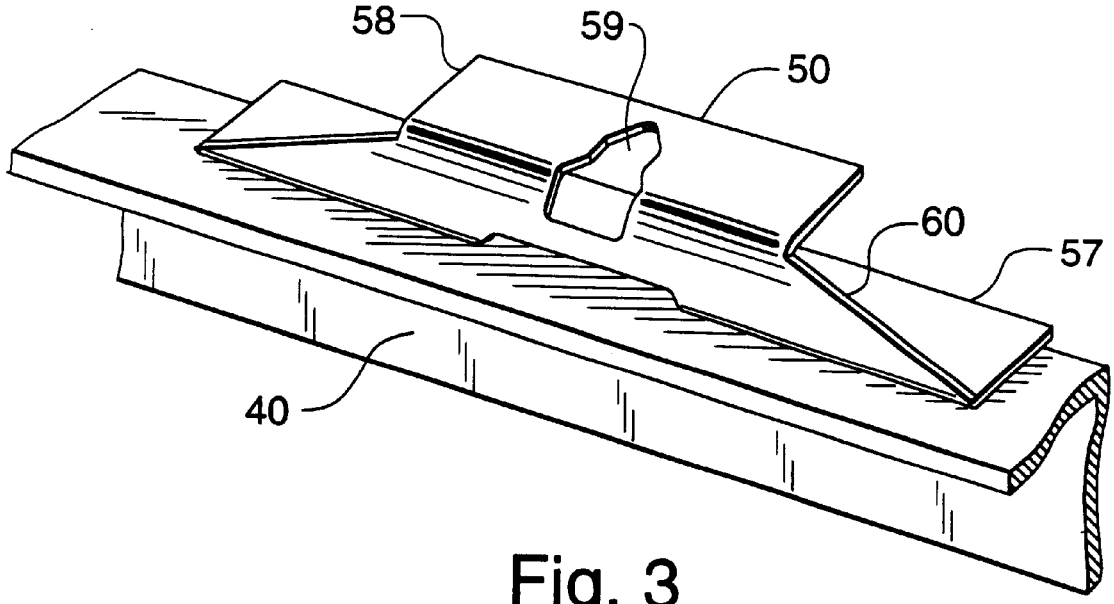
FIG. 3 is a perspective view of a motion arresting bracket attached to a frame.
Figure 4:
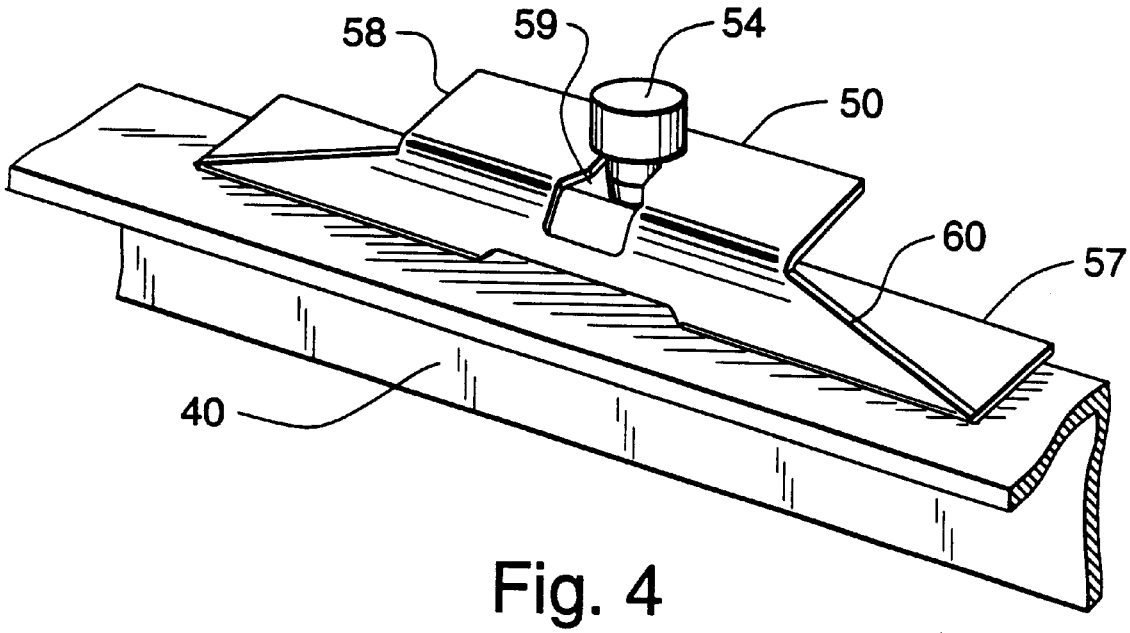
FIG. 4 is a perspective view of the motion arresting bracket of FIG. 3 connected to a support stud.

The present invention improves the shock handling capability especially of a 16×9 tube by the addition of two brackets 50 and 52 to the mask-frame assembly 38, and two additional studs 54 and 56 to the panel 12, to provide means for stopping movement of a mask-frame assembly 38 along the major axis X of the tube 8, as caused by shock. Each bracket 50 or 52 is U-shaped from a single metal plate. As shown in FIGS. 3 and 4, one leg 57 of the U-shaped bracket is attached to the frame 40, while the other leg 58 includes a slot 59 that is open through the bottom 60 of the U-shape of the bracket. Because of the opening in the slot 59, the brackets 50 and 52 can slide onto their respective studs, 54 and 56, without the need for any additional device to depress the brackets. Therefore, the mask-frame assembly 38 can be inserted and removed from the panel 12 by depressing only the four corner springs 42. The additional X direction shock load resistance is achieved when the additional studs engage the sides of the bracket slots, as the shadow mask-frame assembly begins to deflect in the X direction.

In order not to alter the position of the shadow mask 32 in the panel 12, as defined by the corner support springs 42, the brackets 50 and 52 are welded to the frame 40 after the shadow mask is installed in the panel. Preferably, for the brackets 50 and 52, there are small tolerances of about 0.127 mm (0.005") between the studs 54 and 56 and the bracket slots 59. Use of an open slot in a bracket, as disclosed herein, prevents interference during insertion and removal of the shadow mask; also, the brackets do not interfere with any other processing equipment that is used in the tube manufacturing.

Figure 5:
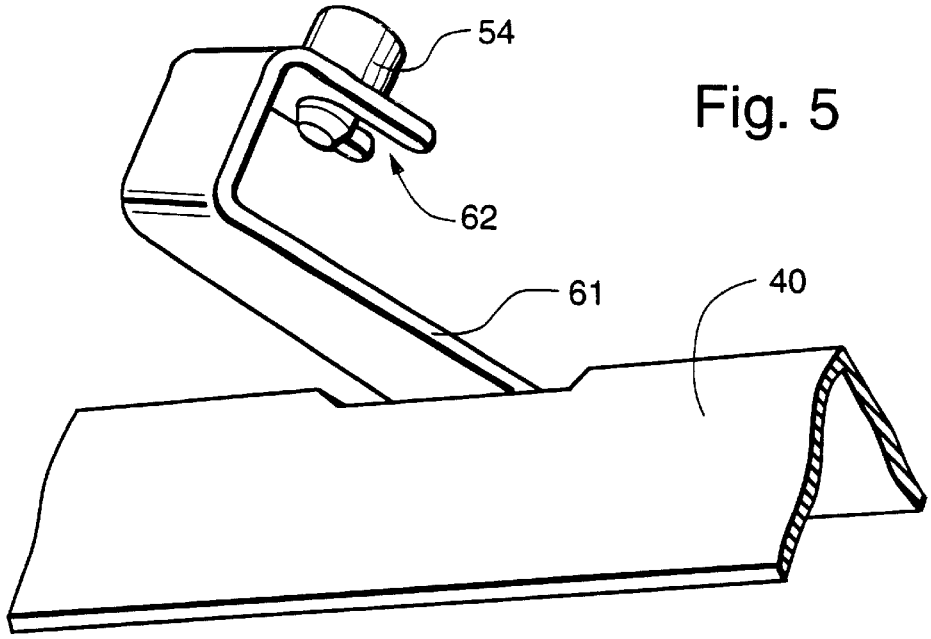
FIG. 5 is the same perspective view of another motion arresting bracket attached to a frame.
Figure 6:
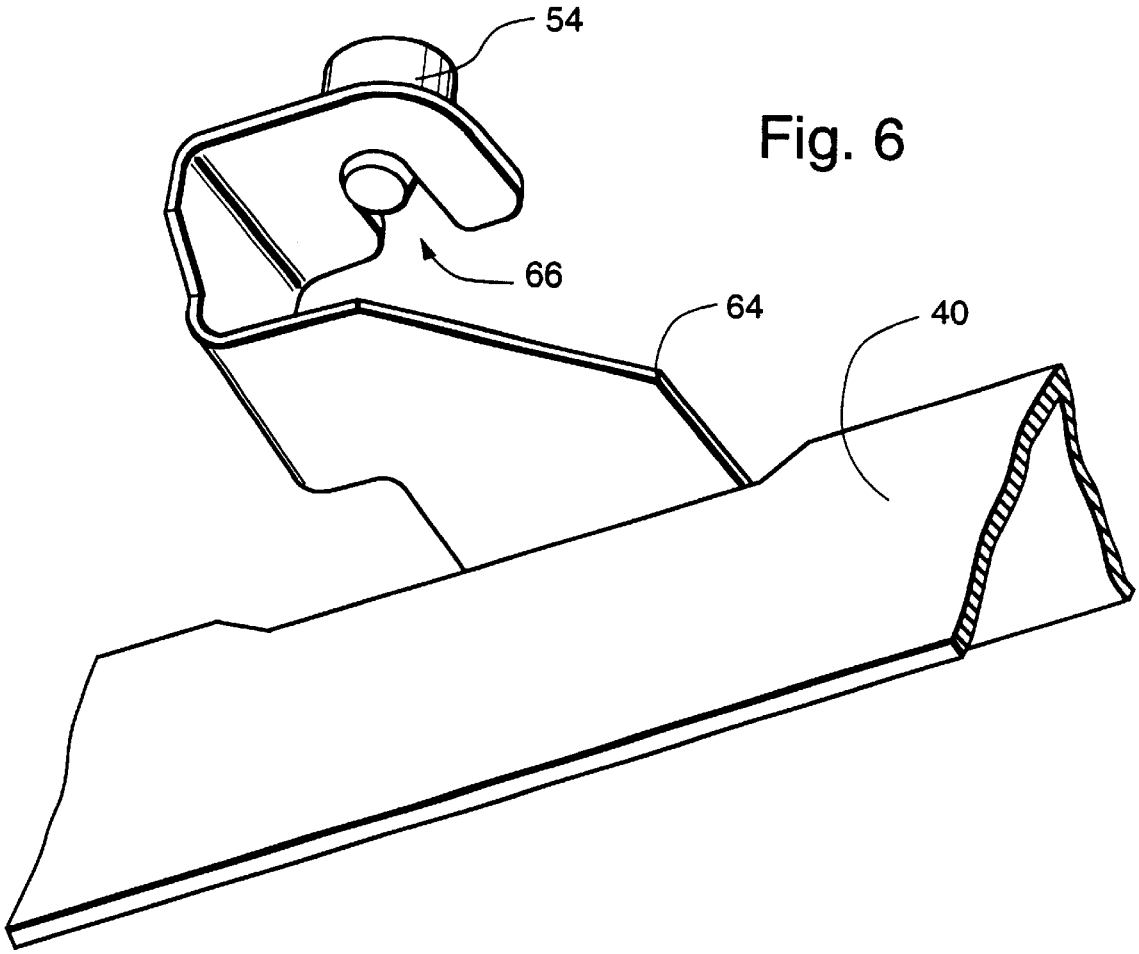
FIG. 6 is a perspective view of a third motion arresting bracket attached to a frame.

The shape of the brackets used may vary to some extent from that described with respect to the preferred embodiment. For example, a bracket 61, shown in FIG. 5, is J-shaped, and another bracket 64 has a somewhat twisted J-shape. Both of these brackets 61 and 64 have slots 62 and 66, respectively, therein that are open facing the faceplate 18, to permit insertion and removal of the mask-frame assembly without the need to depress the brackets. The slots are generally Y-shaped, with the upper tapered portion being used to capture and direct the bracket onto a stud, during mask insertion. The very bottom of the Y-shape is V-shaped to accurately center the slot on the stud, during installation of the bracket on the frame. Once the slot is centered, the bracket is backed-off slightly, so that the stud is centered between the two straight parallel sides of the slot, with slight tolerances therebetween. After the bracket has been so backed-off, it is welded to the frame.

Tests were performed on two 97 cm (38") diagonal tubes having 16×9 aspect ratios. A first tube had the four corner springs, but no brackets. The second tube was constructed with two brackets in addition to the four corner springs. Results indicate that the first tube did not have a shock handling capability to tolerate a 25 gs X-direction shock, whereas the second tube, with the two brackets, demonstrated satisfactory X-direction shock handling capability at shock levels up to 35 gs.

Although the present invention has been described with respect to a tube having a line screen, which is more sensitive to horizontal misregister than to vertical misregister, it is to be understood that the invention may also be applied to a tube having a dot screen, which is sensitive to misregister in both the horizontal and vertical directions. In the latter case, however, two additional brackets could be installed at the centers of the short sides of the panel to also improve shock capability in the vertical direction.

What is claimed is:

1. A color picture tube including an evacuated envelope having a rectangular faceplate panel with two approximately parallel long sides, two approximately parallel short sides and four corners, said panel comprising a faceplate and a peripheral sidewall, said panel further including a shadow mask-frame assembly mounted therein by springs located at the four corners of said panel, said springs having apertures engaging studs located on said peripheral sidewall at said four corners, said panel including additional studs on said peripheral sidewall located near the centers of at least one pair of said approximately parallel sides, and brackets located on the opposite sides of said shadow mask-frame assembly at the locations of said additional studs, said brackets including slots therein, said slots being open on sides thereof facing said faceplate, and said additional studs being positioned within said slots.

2. A color picture tube including an evacuated envelope having a rectangular faceplate panel with two long sides, two short sides and four corners, said panel comprising a faceplate and a peripheral sidewall, said panel further including a shadow mask-frame assembly mounted therein by springs located at the four corners of said panel, said springs having apertures engaging studs located on said peripheral sidewall at said four corners, said panel including two additional studs on said peripheral sidewall located near the centers of said long sides, and two brackets located on the opposite long sides of said shadow mask-frame assembly at the locations of said two additional studs, said brackets including slots therein, said slots being open on sides thereof facing said faceplate, and said two additional studs being positioned within said slots.

3. The tube as defined in claim 2, wherein there is a small tolerance between said two additional studs and said slots.

4. The tube as defined in claim 2, wherein said panel includes a line screen.

5. The tube as defined in claim 2, wherein said panel has an approximate 16 by 9 aspect ratio.

6. The tube as defined in claim 2, wherein each of said slots is generally Y-shaped, with the Y-shape having a V-shape at the bottom thereof.

* * * * *